US008783203B1

(12) United States Patent
Woods

(10) Patent No.: US 8,783,203 B1
(45) Date of Patent: Jul. 22, 2014

(54) TWO-PIECE MODULAR BOAT

(76) Inventor: Danny C. Woods, Meridian, MS (US)

( * ) Notice: Subject to any disclaimer, the term of this patent is extended or adjusted under 35 U.S.C. 154(b) by 0 days.

(21) Appl. No.: 13/402,950

(22) Filed: Feb. 23, 2012

(51) Int. Cl.
*B63B 7/04* (2006.01)

(52) U.S. Cl.
USPC ..... 114/352; 114/353; 114/354

(58) Field of Classification Search
USPC ..... 114/352, 353, 354
See application file for complete search history.

(56) References Cited

U.S. PATENT DOCUMENTS

| | | | | |
|---|---|---|---|---|
| 957,820 | A | 5/1910 | Vaniman | |
| 3,266,067 | A | 8/1966 | Windle | |
| 3,340,552 | A | 9/1967 | Moye | |
| 3,744,071 | A | 7/1973 | Bossler, Jr. | |
| 3,996,634 | A | 12/1976 | Grind | |
| 4,478,167 | A | 10/1984 | Hart | |
| 5,477,804 | A * | 12/1995 | Chan | 114/354 |
| 5,488,922 | A * | 2/1996 | Hinderberger | 114/354 |
| 5,515,805 | A * | 5/1996 | Johanson | 114/344 |
| 5,868,097 | A * | 2/1999 | Spickelmire | 114/353 |
| 6,145,465 | A * | 11/2000 | Murphree | 114/353 |
| 6,325,013 | B1 * | 12/2001 | Brown | 114/352 |
| 6,354,236 | B1 * | 3/2002 | Davidson | 114/271 |
| 6,367,404 | B1 * | 4/2002 | Callahan | 114/353 |
| 6,612,255 | B1 * | 9/2003 | Wragg | 114/352 |
| 6,637,362 | B1 * | 10/2003 | Avidiya | 114/352 |

* cited by examiner

*Primary Examiner* — Lars A Olson
*Assistant Examiner* — Jovon Hayes
(74) *Attorney, Agent, or Firm* — Montgomery Patent & Design; Robert C Montgomery

(57) ABSTRACT

A boat comprising a two-piece construction which consequently conserves space during storage and transportation is herein disclosed. The apparatus splits in half to allow the forward half hull to be stored within the aft half hull portion. When joined, the apparatus appears and performs as a conventional small one-piece flat boat. Each half hull portion resembles a conventional shape; however comprises an additional centrally-located bulkhead portion, thereby forming a pair of completely watertight half hulls. Said half hulls are then attached securely via mating features and locking pins to form a rigid boat structure.

17 Claims, 9 Drawing Sheets

TWO-PIECE MODULAR BOAT

RELATED APPLICATIONS

There are currently no applications co-pending with the present application.

FIELD OF THE INVENTION

The present invention relates generally to a modular boat, and in particular, to a modular boat comprising a pair of hulls.

BACKGROUND OF THE INVENTION

Modular boats are known and are utilized to compact the boat for transporting necessities. Various sectional boats include a plurality of sections or hulls which need to be locked to one (1) another in order to utilize the boat. This becomes time consuming and cumbersome.

Various attempts have been made to provide modular boat. Examples of these attempts can be seen by reference to several U.S. patents. U.S. Pat. No. 2,650,376, issued in the name of Sommer, describes a modular boat which enables separation for nesting during transportation.

U.S. Pat. No. 3,744,071, issued in the name of Bossler, Jr., describes a modular boat which enables the boat to be built in various configurations.

U.S. Pat. No. 6,637,362, issued in the name of Avidiya, describes a modular boat comprises a pair of lockable hull portions which are floatable.

While these devices fulfill their respective, particular objectives, each of these references suffer from one (1) or more disadvantages. Many such devices are not suited to quickly assemble and disassemble. Another problem area is that many devices are not user friendly and awkward to erect. Accordingly, there exists a need for a modular boat without the disadvantages as described above. The development of the present invention substantially departs from the conventional solutions and in doing so fulfills this need.

SUMMARY OF THE INVENTION

The inventor has recognized the aforementioned inherent problems and lack in the art and observed that there is a need for a modular boat.

Accordingly, it is an object of the present embodiments of the invention to solve at least one (1) of these problems. The inventor has addressed this need by developing a modular boat which is assembled and disassembled quickly and in a user friendly fashion.

To achieve the above objectives, it is an object of the present invention to provide a modular boat which conserves space during storage and transportation by splitting in half.

Another object of the present invention is to provide the modular boat with a forward half hull portion and an aft half hull portion; each half hull further comprises a bulkhead to form a pair of completely watertight half hulls.

Yet still another object of the present invention is to provide locking pins to fasten the half hulls.

Yet still another object of the present invention is to provide an auxiliary seat assembly.

Yet still another object of the present invention is to provide the auxiliary seat assembly comprises an auxiliary seat panel having a channel-shaped cross section which spans a width of the aft half hull being supported at end locations by respective support brackets which are permanently welded to respective aft starboard and aft port walls.

Yet still another object of the present invention is to provide a method of utilizing the device that provides a unique means of attaching the forward half hull to the aft half hull, inserting the locking pins, installing the auxiliary seat assembly, fastening and launching the modular boat, and reversing the procedure to transport the modular boat.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

| DESCRIPTIVE KEY | |
|---|---|
| 10 | two-piece modular boat |
| 20 | forward half hull |
| 22 | forward starboard wall |
| 23 | forward port wall |
| 24 | forward front wall |
| 26 | forward stiffener |
| 28 | forward hull floor |
| 30 | flotation enclosure |
| 32 | pull handle |
| 40 | aft half hull |
| 42 | aft starboard wall |
| 43 | aft port wall |
| 44 | aft rear wall |
| 46 | aft stiffener |
| 48 | aft hull floor |
| 50 | motor mounting panel |
| 52 | gusset plate |
| 60 | joint assembly |
| 62 | male side post |
| 63 | post aperture |

-continued

| DESCRIPTIVE KEY | |
|---|---|
| 64 | male bottom post |
| 66 | female side channel |
| 67 | channel aperture |
| 68 | female bottom channel |
| 70 | forward hull bulkhead |
| 72 | aft hull bulkhead |
| 80 | joint seat assembly |
| 82 | joint seat panel |
| 84 | joint attachment bracket |
| 86 | joint cut-out |
| 88 | locking pin |
| 90 | bracket aperture |
| 100 | auxiliary seat assembly |
| 102 | auxiliary seat panel |
| 104 | support bracket |
| 110 | locking bracket assembly |
| 111 | bracket track |
| 112 | locking bracket slide plate |
| 114 | stationary hook |
| 116 | mobile hook |
| 118 | slot |
| 120 | wing bolt fastener |
| 200 | operator |

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
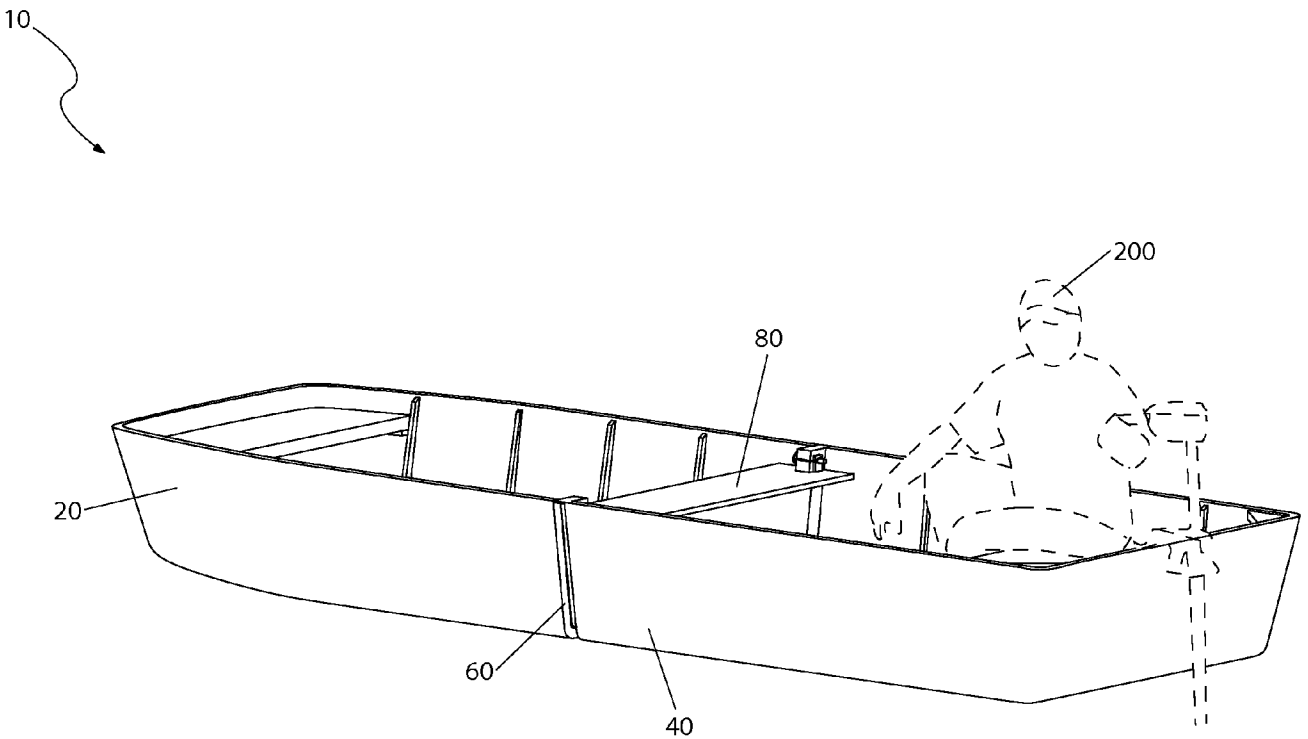
FIG. 1 is an environmental view of a two-piece modular boat 10, according to a preferred embodiment of the present invention.

Referring now to FIG. 1, an environmental view of the two-piece modular boat (herein described as the "apparatus") 10, which provides a two-piece flat boat which conserves space during storage and transportation by splitting in half and allowing a forward half hull portion 20 to be stored within an aft half hull portion 40. When joined, the apparatus 10 appears and performs in like fashion as a conventional small one-piece flat boat and is envisioned to be introduced in different overall length of between twelve (12) and eighteen (18) feet and three (3) feet in width. Each half hull portion 20, 40 of the apparatus 10 comprises an additional bulkhead 70, 72, thereby forming a pair of completely watertight half hulls 20, 40. The half hulls 20, 40 are arranged such that the bulkheads 70, 72 are arranged adjacent to each other and said half hulls 20, 40 are joined together along side and bottom edges by respective mating post and channel features being locked together using two (2) locking pins 88 able to be discretely covered by a joint seat panel 82. The apparatus 10 is illustrated here being equipped with one (1) removable auxiliary seat assembly 100; however, additional auxiliary seats 100 may be provided based upon an actual length of the apparatus 10, and as such should not be interpreted as a limiting factor of the apparatus 10. When the half hulls 20, 40 are separated and the forward half hull portion 20 is stored within the aft half hull portion 40, the apparatus 10 may be stored in a space approximately half the size of the joined boat 10.

Figure 2:
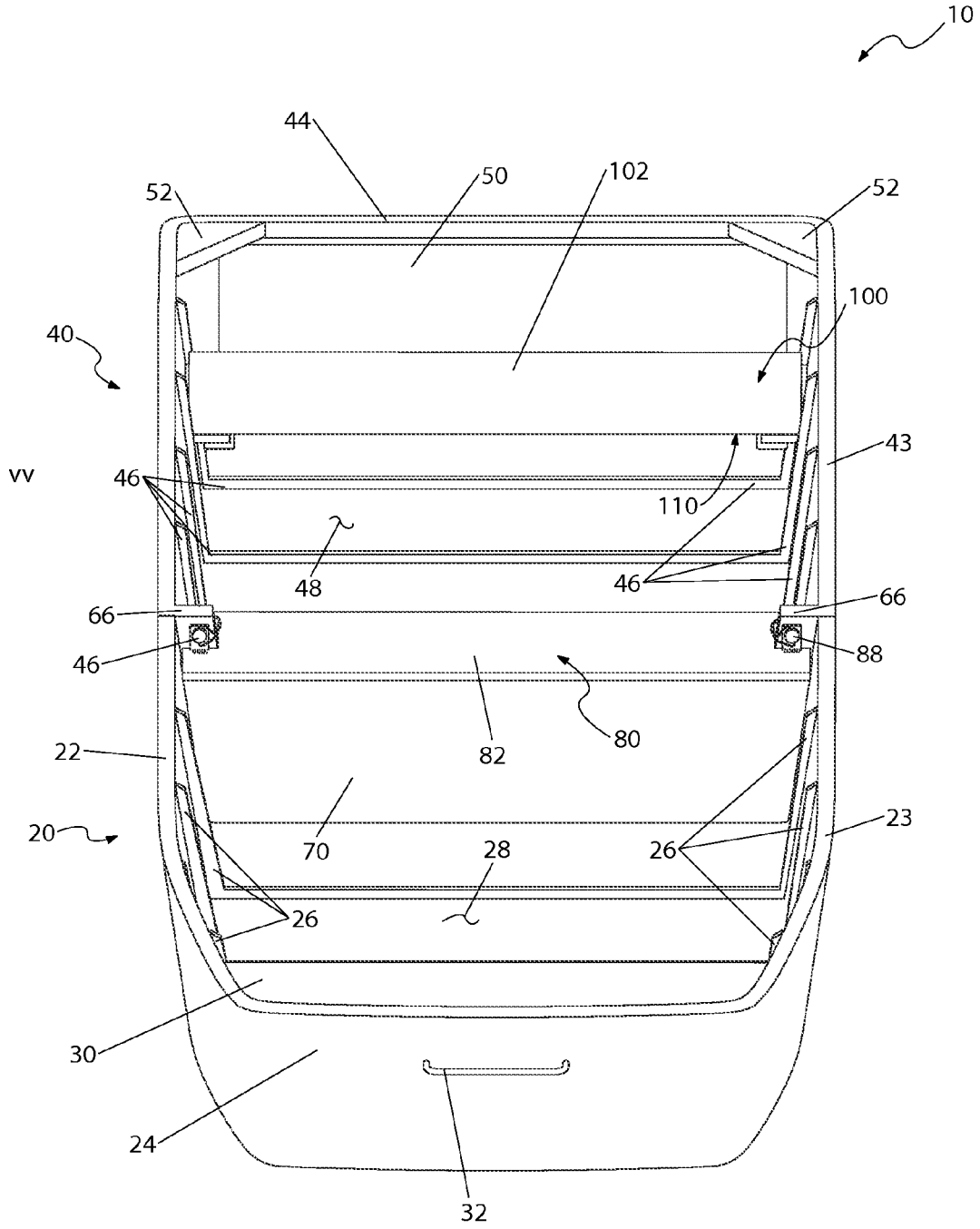
FIG. 2 is a top perspective view of the two-piece modular boat 10, according to a preferred embodiment of the present invention.

Referring now to FIG. 2, a top perspective view of the apparatus 10, according to a preferred embodiment of the present invention, is disclosed. The apparatus 10 comprises an open-top flat bottom boat preferably made using rugged welded aluminum construction; however, it is understood that said apparatus 10 may also be introduced being made of steel, fiberglass, acrylonitrile butadiene styrene (ABS), or other equivalent materials, and as such should not be interpreted as a limiting factor of the apparatus 10. Furthermore, the apparatus 10 may be introduced in various lengths envisioned to range from approximately twelve (12) to eighteen (18) feet.

The forward half hull portion 20 of the apparatus 10 provides a rugged downwardly-tapering unitary structure having five (5) sides and further comprising a forward starboard wall 22, a forward port wall 23, a forward front wall 24 having a welded pull handle 32, a plurality of welded parallel stiffeners 26, a forward hull floor 28, a floatation enclosure 30, and a forward hull bulkhead 70. The pull handle 32 is centrally located adjacent to an upper outer edge of the forward front hull 24 and projecting outwardly. Said forward hull portions 22, 23, 24, 26, 28, 30, 32, 70 are preferably attached to each other using standard welding methods; however, equivalent fastening methods such as riveting may be utilized to form a rigid structure. The forward hull stiffeners 26 are preferably made using welded structural angle shapes which form equally-spaced "ribs" being arranged in a lateral orientation across the forward half hull 20. Each stiffener 26 extends down the forward starboard wall 22, across the forward hull floor 28, and up the forward port wall portion 23 being securely welded to said walls 22, 23 and floor 28 portions. The forward half hull 20 is further envisioned to comprise a rectangular flotation enclosure 30 which extends across and is integrated into a bow portion of the forward half hull 20. The flotation enclosure 30 provides a containment means to a quantity of buoyant material such as polystyrene in accordance with applicable state and federal regulations pertaining to watercraft safety.

The aft half hull 40 comprises similar construction as the forward half hull 20 having respective portions including an aft starboard wall 42, an aft port wall 43, an aft rear wall 44, a plurality of aft stiffeners 46, an aft hull floor 48, and an aft hull bulkhead 72. Additionally, the aft rear wall portion 44 is envisioned to further provide a permanently attached wooden motor mounting panel 50 along an inner surface portion onto which a conventional outboard motor may be affixed. Said aft rear wall 44 is illustrated here also utilizing a pair of triangular gusset plates 52 welded to top outer corner junctions with the aft starboard 42 and port 43 walls for additional strength; however, it is understood that additional gusset plates 52 and other structurally strengthening members may be provided as needed to add structural strength to the apparatus 10 based upon an actual overall length, anticipated loading scenarios, and the like. The aft half hull 40 is illustrated here further comprising a removably attached auxiliary seat assembly 100 positioned so as to provide comfortable seating for an operator 200 (see FIGS. 1, 5*a* and 5*b*).

Figure 4A:
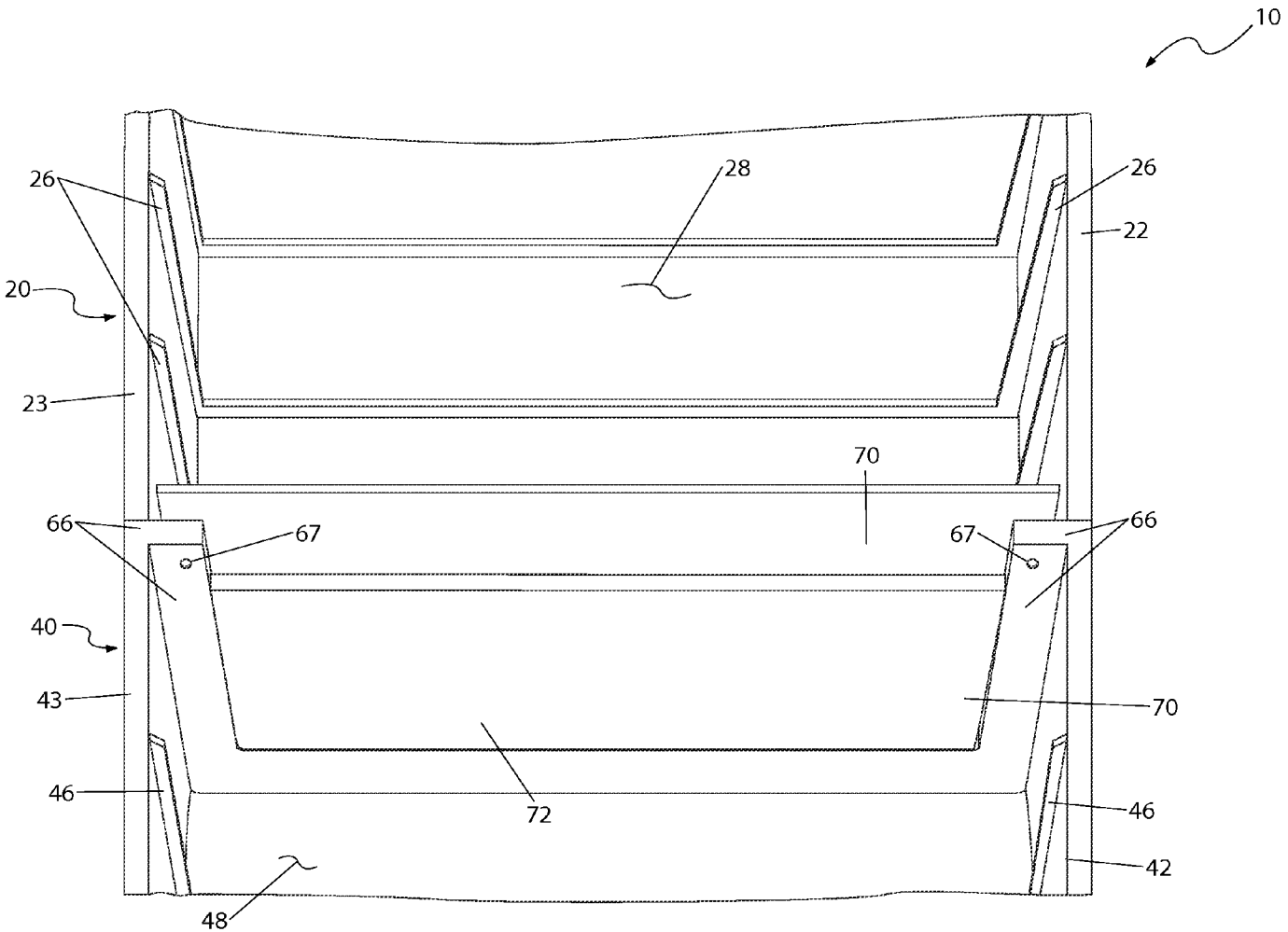
FIG. 4*a* is a perspective view of the two-piece modular boat 10 depicting removal of a joint seat assembly portion 80, according to a preferred embodiment of the present invention.
Figure 4B:
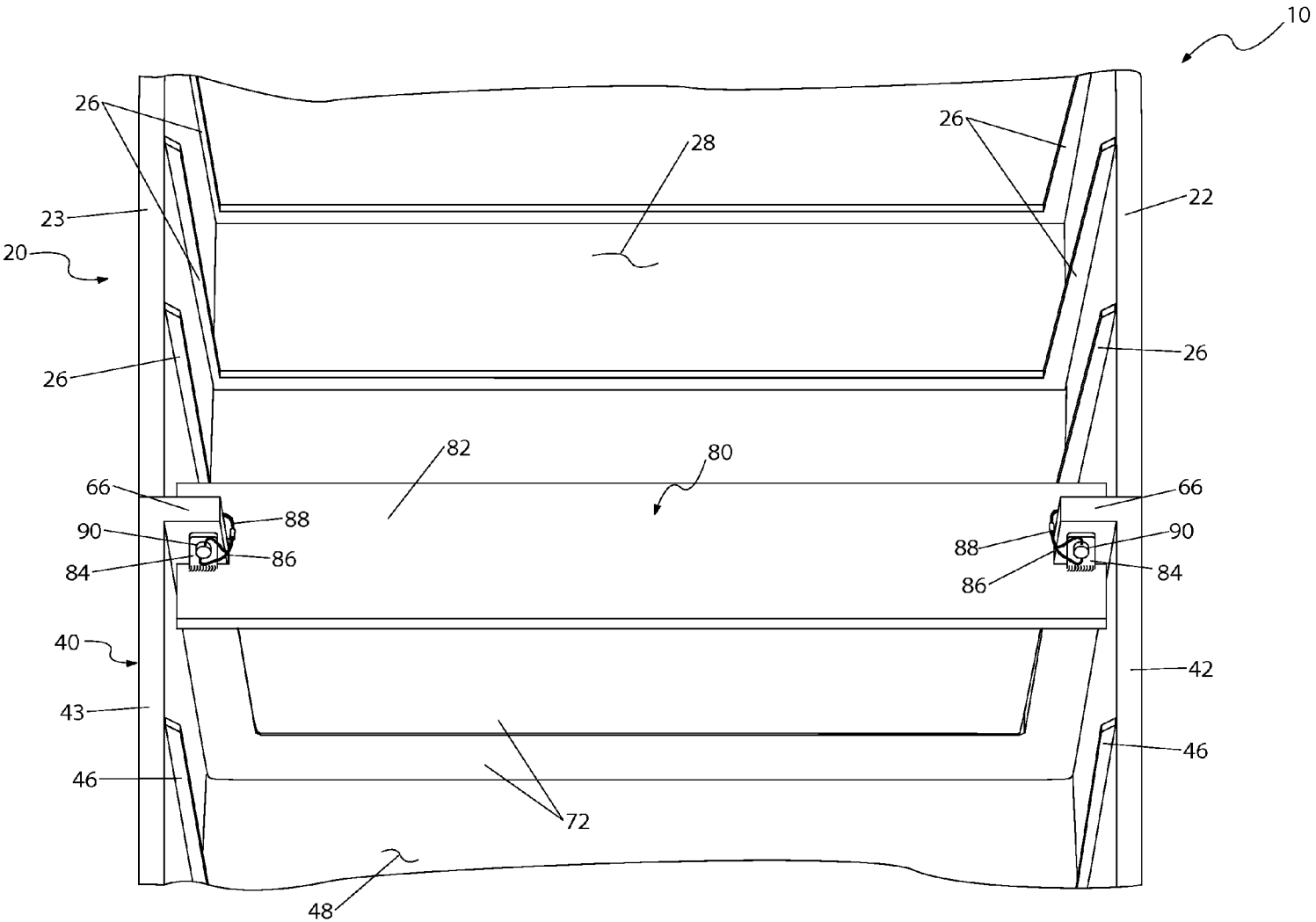
FIG. 4*b* is an assembled view of the two-piece modular boat 10 depicting installation of the joint seat assembly portion 80, according to a preferred embodiment of the present invention.

The forward 20 and aft 40 half hulls are rigidly joined by a joint assembly 60 which is in turn discretely and functionally covered with a removably attached joint seat assembly 80 (see FIGS. 4*a* and 4*b*).

Figure 3A:
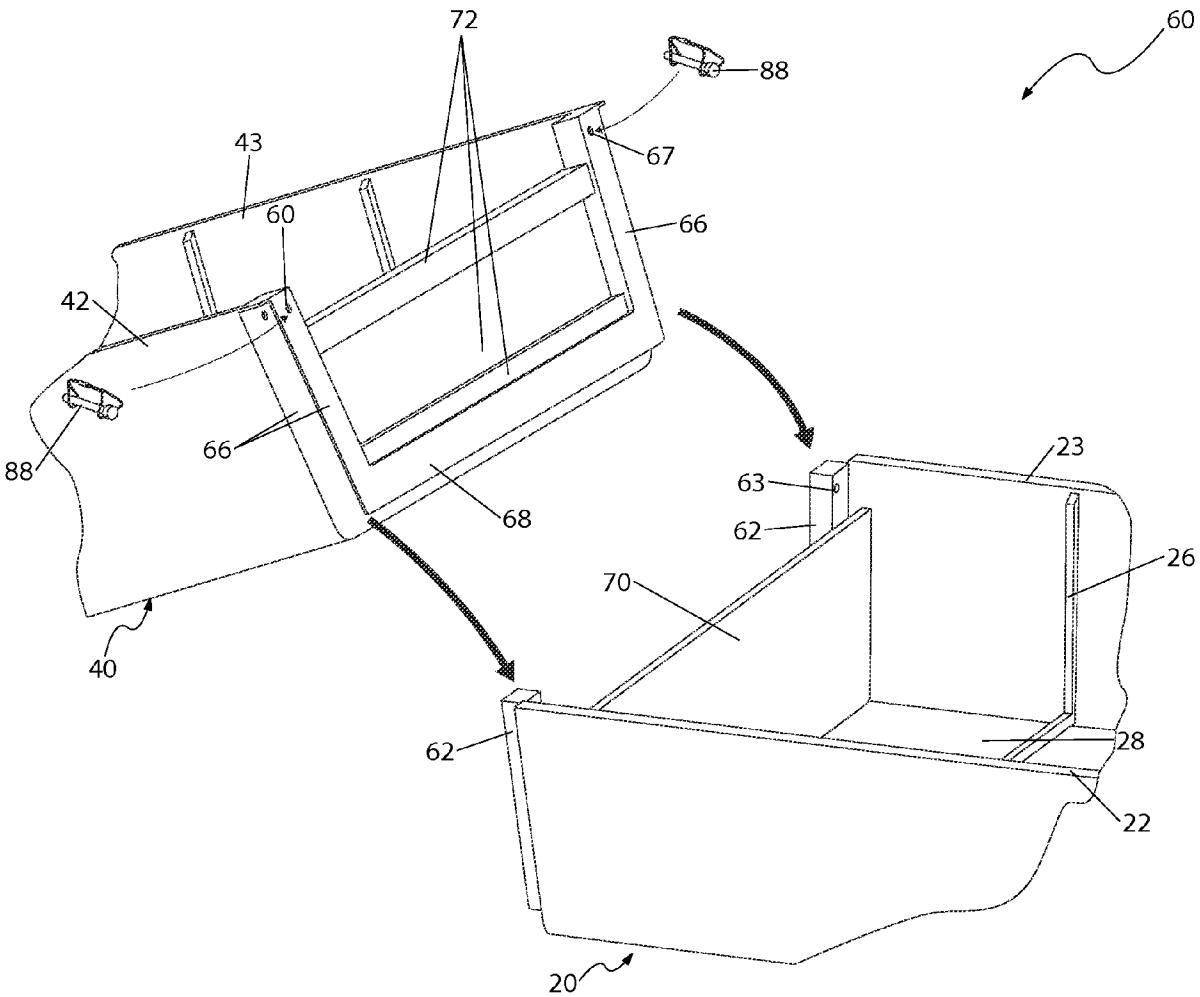
FIG. 3*a* is a right side perspective view of a joint assembly portion 60 of the two-piece modular boat 10, according to a preferred embodiment of the present invention.
Figure 3B:
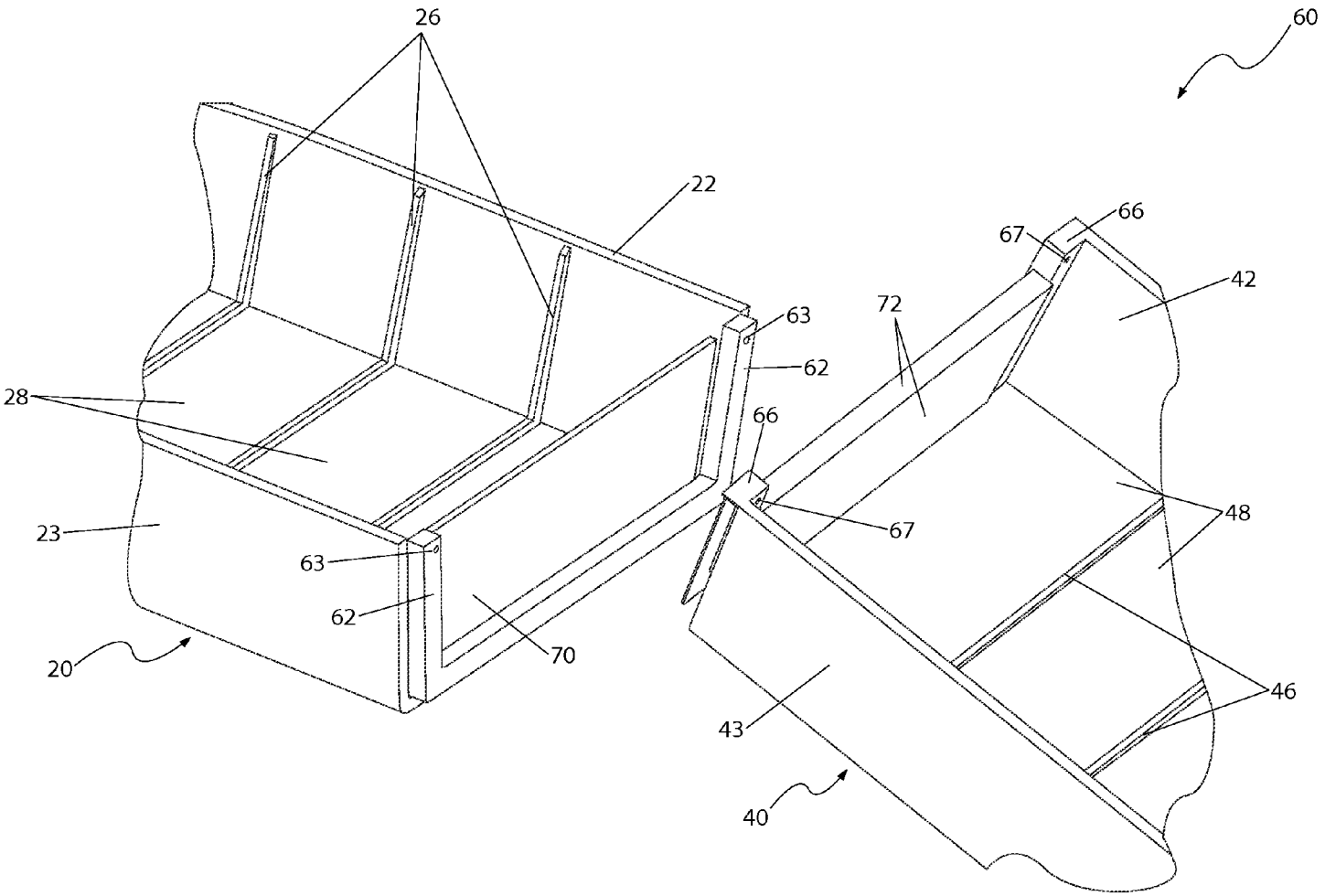
FIG. 3*b* is a left side perspective view of a joint assembly portion 60 of the two-piece modular boat 10, according to a preferred embodiment of the present invention.

Referring now to FIGS. 3*a* and 3*b*, right side and left side perspective views of a joint assembly portion 60 of the apparatus 10, according to a preferred embodiment of the present invention, are disclosed. The forward 20 and aft 40 half hull portions of the apparatus 10 utilize a joint assembly 60 which provides rigid attachment of said half hull portions 20, 40 together using interlocking features being positioned adjacent to the aforementioned forward 70 and aft 72 hull bulkheads which provide a rigid attachment to form a joined unitary boat structure (see FIG. 2). The forward half hull 20 comprises a three (3) sided structure further comprising a pair of outer side male posts 62 which are spanned between bottom end portions by a bottom male post 64. Said side 62 and bottom 64 male posts are integrated and welded to respective forward walls 22, 23 and forward hull floor 28 portions along a rearward edges being parallel to the previously described forward stiffeners 26. Said side 62 and bottom 64 male posts comprise welded linear structures being welded closed and having rectangular cross sections. When joining said forward 20 and aft 40 half hulls, said side 62 and bottom 64 male posts are to be inserted into corresponding female mating features of the aft half hull 40 comprising a respective pair of side female channels 66 and a joining bottom female channel 68. Said side 66 and bottom 68 female channels comprise welded channel-shaped forms with an open side portion facing in respective outward and downward directions so as to snuggly receive respective side 62 and bottom 64 male posts within. Said side male posts 62 and side female channels 66 comprise correspondingly positioned post apertures 63 and channel apertures 67, respectively. Once said male posts 2, 64 and said female channels 66, 68 are fully engaged, said post 63 and channel 67 apertures are to align along a horizontal axis to allow insertion of a locking pin 88 completely through the post 62 and channel 66 portions, thereby securing the two (2) half hulls 20, 40 and the joint seat assembly 80 together (see FIG. 4*b*). The locking pin 88 is envisioned to comprise a standard wire snapper pin or equivalent self-retaining fastener.

Referring now to FIGS. 4*a* and 4*b*, perspective views of the apparatus 10 depicting removal and installation of the joint seat assembly portion 80, according to a preferred embodiment of the present invention, are disclosed. The joint seat assembly 80 provides a functional mid-positioned seating panel 82 being positioned above, and discretely covering, the previously described side post 62 and side channel 66 portions as well as the forward 70 and aft 72 hull bulkheads. The joint seat panel 82 comprises an inverted "U"-shaped metal structure having a particular length and end profile so as to fit snuggly between the starboard and port wall portions 23, 24, 42, 43 while coincidentally resting coincidentally upon top surfaces of both hull bulkheads 70, 72. Said joint seat panel 82 further provides an attachment means to the aforementioned female side channels 66 via comprises a pair of perpendicularly-formed joint attachment brackets 84 and adjacent joint cut-out portions 86. Each cut-out 86 comprises a rectangular opening which provides a close fit around the respective female side channel 66. The joint attachment bracket 84 provides parallel contact along a side surface of said female side channel 66. The joint attachment bracket 84 further comprises a centrally-located bracket aperture 90 being correspondingly aligned with the previously described post 63 and channel 67 aperture portions of respective side posts 62 and side channels 66. Said apertures 63, 67, 90 allow insertion of the two (2) locking pins 88 completely through said post 62, 64, channel 66, 68, and bracket 84 portions, thereby fastening the half hulls 20, 40 together using only two (2) fasteners 88, providing quick insertion or removal.

Figure 5A:
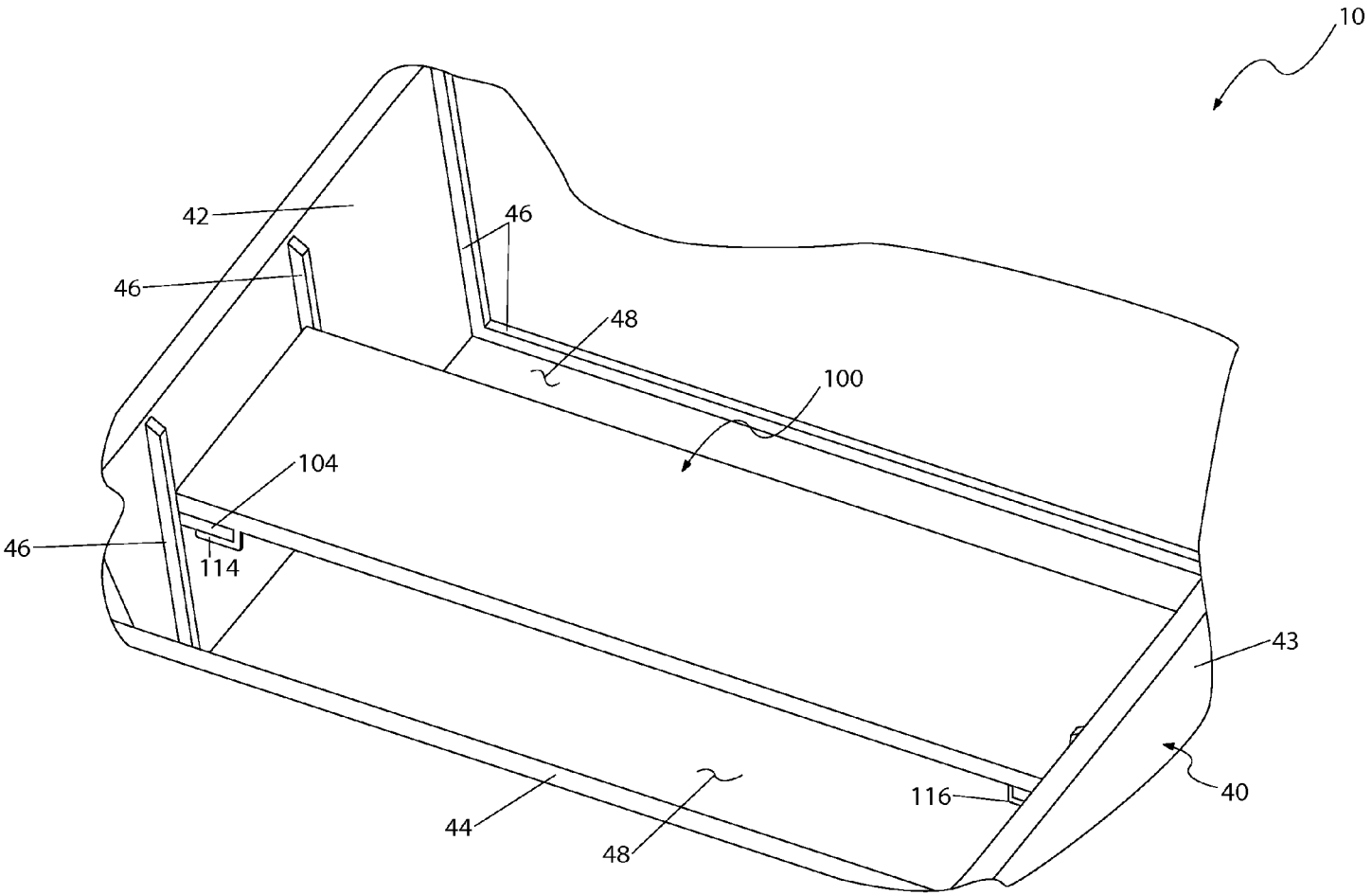
FIG. 5*a* is a perspective view of an auxiliary seat assembly portion 100 of the two-piece modular boat 10, according to a preferred embodiment of the present invention.

Referring now to FIG. 5*a*, a perspective view of an auxiliary seat assembly portion 100 of the apparatus 10, according to a preferred embodiment of the present invention, is disclosed. The auxiliary seat assembly 100 provides removably attachable lateral seating to the operator 200 as well as passengers within the apparatus 10. The auxiliary seat assembly 100 comprises an auxiliary seat panel 102 having a channel-shaped cross section which spans a width of the aft half hull 40 being supported at end locations by respective support brackets 104 which are permanently welded to respective aft starboard 42 and aft port walls 43 (see FIG. 5*b*). The apparatus 10 is illustrated herein having one (1) auxiliary seat assembly 100 positioned so as to be utilized by an operator 200 seated within the aft half hull 40 being convenient for normal motorized piloting of the apparatus 10 (see FIG. 1). However, it is understood that additional auxiliary seats 100 may be provided in forward 20 or aft 40 half hulls based upon an actual length of the apparatus 10, and as such should not be interpreted as a limiting factor of the apparatus 10.

Figure 5B:
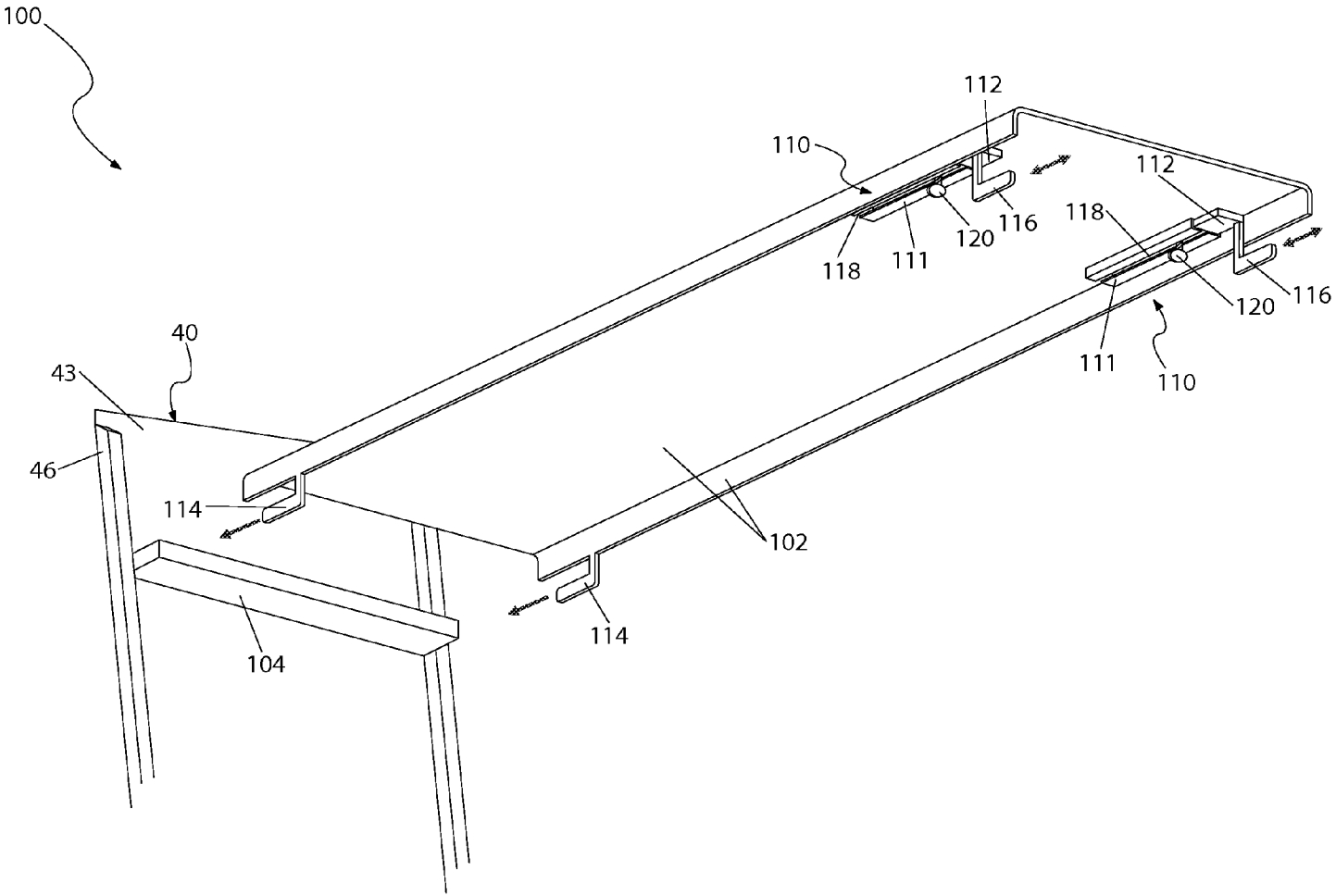
FIG. 5*b* is a bottom view of the auxiliary seat assembly 100 depicting support bracket 104 and locking bracket assembly 110 portions, according to a preferred embodiment of the present invention.

Referring now to FIG. 5*b*, a bottom view of the auxiliary seat assembly 100 depicting support bracket 104 and locking bracket assembly 110 portions, according to a preferred embodiment of the present invention, is disclosed. The half hull portions 20, 40 may be outfitted with opposing pairs of support brackets 104 at locations where additional auxiliary seat assemblies 100 are desired. Said support brackets 104 comprise a length of flat stock being positioned horizontally between a pair of adjacent stiffeners 26, 46, being welded to said stiffeners 26, 46 and adjacent wall portions 22, 23, 42, 43. The auxiliary seat assembly 100 provides an attachment means to said support brackets 104 via a locking bracket assembly portion 110 of the auxiliary seat assembly 100. Said locking bracket assembly portion 110 further comprises a pair of stationary hooks 114 and a pair of mobile hooks 116. Said pairs of hooks 114, 116 are located at opposite ends of the auxiliary seat panel 102 being attached along a bottom surface having outwardly-facing slot portions which are sized and positioned so as to snuggly engage edge portions of respective support brackets 104. The mobile hooks 116 provide a horizontal motioning means so as to engage a support bracket 104 via a pair of locking bracket extensions 112 having respective bracket track 111, slot 118 and wing bolt fastener 120 portions. Said locking bracket extensions 112 comprise inwardly formed perpendicular extensions of a bottom edge of the auxiliary seat panel 102. The bracket track 111 comprises a channel-shaped structure having an open slot portion 118 facing in a downward direction. Said slot portions 118 allow the wing bolt fastener 120 to be inserted through said slot 118 and threadingly engage a rear portion of the locking bracket extensions 112 to abut against the rear wall of the bracket track 111. In this manner, the mobile hook 116 may be slid away from or toward the support bracket 104 until securely engaged. Once both pairs of hooks 114, 116 are engaged with the respective support brackets 104, the wing bolt fasteners 120 are tightened to secure the position of the mobile hooks 116, thereby locking the auxiliary seat panel 102 in position.

Figure 6:
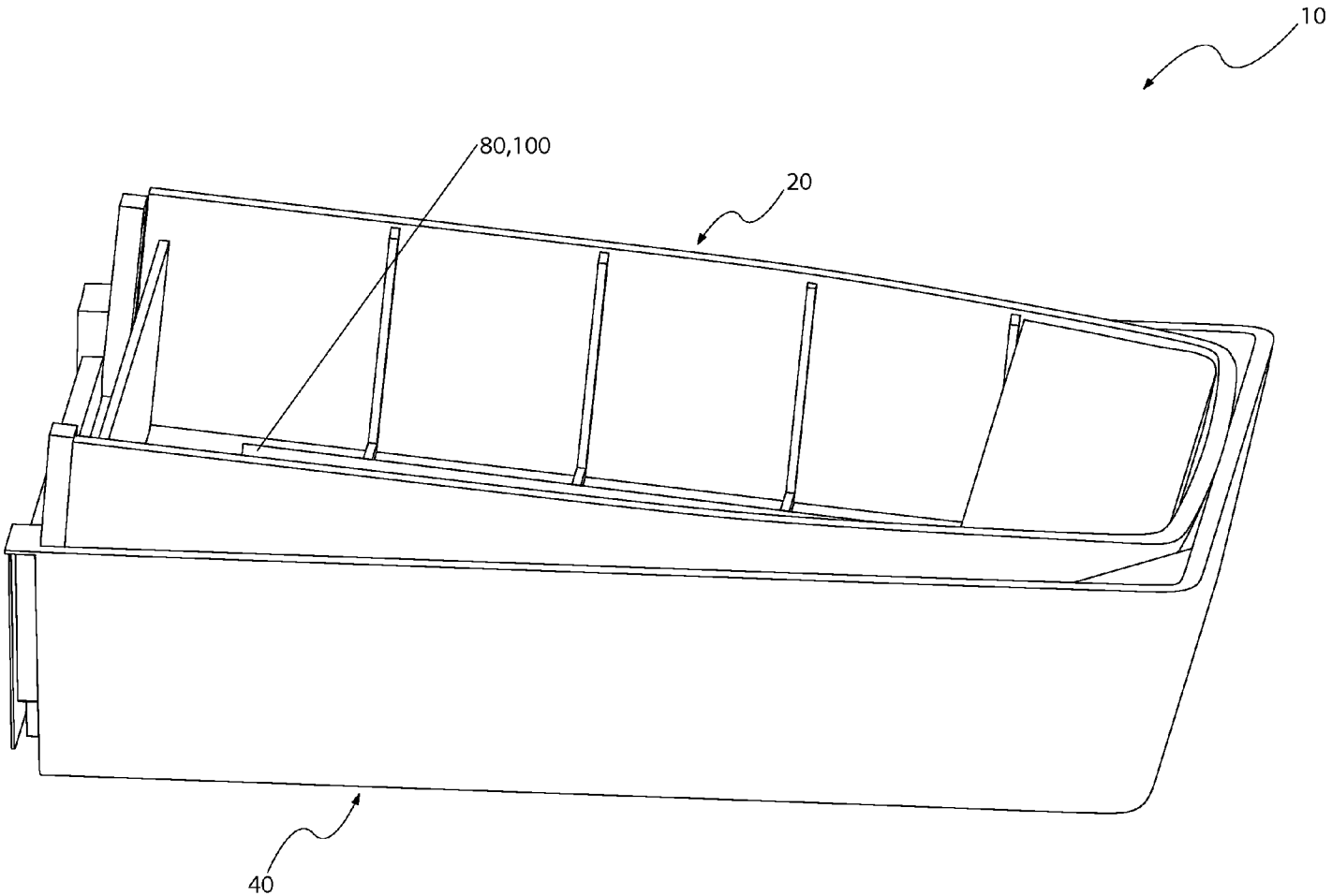
FIG. 6 is a perspective view of the two-piece modular boat 10 depicting a separated and stacked storage state, according to a preferred embodiment of the present invention.

Referring now to FIG. 6, a perspective view of the apparatus 10 depicting a separated and stacked state, according to a preferred embodiment of the present invention, is disclosed. The apparatus 10 provides compact transportation and storage by detaching the joint seat 80 and auxiliary seat 100 assemblies, removing the locking pins 88 to detach and lift the separate the half hulls 20, 40, and inserting the forward half hull 20 downwardly into the aft half hull 40. Finally, the seat assemblies 80, 100 as well as any related items, may be stored within the forward half hull 20. Said compact arrangement of the half hulls 20, 40 reduces an overall length of the apparatus 10 by approximately one-half (½), thereby enabling an operator 200 to transport the apparatus 10 within a pick-up truck bed or similar cargo-carrying vehicle in lieu of a boat trailer. Said compact stacking of the half hulls 20, 40 also saves space during storage of the apparatus 10 within garages or sheds when not in use.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be assembled and utilized as indicated in FIGS. 1 and 2.

The method of installing and utilizing the apparatus 10 may be achieved by performing the following steps: procuring the apparatus 10 having a desired length and number of auxiliary seat assemblies 100 and support brackets 104; placing the forward half hull 20 upon a ground surface; lifting the aft half hull portion 40; positioning the female side 66 and female bottom 68 channel portions of the aft half hull 40 above respective male side 62 and male bottom 64 post portions of the forward half hull 20; lowering said aft half hull 40 downwardly to engage said channel portions 66, 68 with the subjacent post portions 62, 64; placing the joint seat assembly 80 over the two (2) female side channels 66 until said joint seat panel 82 contacts a top surface of the forward 70 and aft 72 hull bulkheads; inserting the two (2) locking pins 88 through the channel apertures 67, the joint attachment bracket 84, and the post apertures 63 on each side of the apparatus 10; installing the auxiliary seat assembly 100 within the aft half hull 40 by loosening the two (2) wing bolt fasteners 120; sliding the wing bolt fasteners 120 along the slots 118, thereby positioning the mobile hooks 116 toward a center portion of the auxiliary seat assembly 100; engaging the stationary hooks 114 onto a support bracket 104; lowering the auxiliary seat assembly 100 downwardly against the aft wall portion 42, 43; engaging the mobile hooks 116 by sliding the wing bolt fasteners 120 outwardly toward said wall portion 42, 43 until the mobile hooks 116 engage the support bracket 104; tightening the wing bolt fasteners 120 to secure said auxiliary seat assembly 100 in position; launching the apparatus 10 into a body of water such as a lake or pond in a conventional manner; and, utilizing the apparatus 10 in like manner as a common flat-bottom boat for fishing, transporting people or goods, and the like, using the present invention 10.

The method of disassembling, transporting, and storing the apparatus 10 may be achieved by performing the following steps: removing the auxiliary seat assembly 100 by loosening the wing bolt fasteners 120 and sliding the mobile hooks 116 away from the support bracket 104; lifting and removing the auxiliary seat assembly 100; removing the joint seat assembly 80 by removing the locking pins 88; lifting and removing said joint seat assembly 80; separating the half hulls 20, 40 by lifting the aft half hull 40 upward until clear of the forward half hull 20; setting the aft half hull 40 aside upon a ground surface; inserting the forward half hull 20 downwardly into the aft half hull 40; placing the auxiliary seat assembly 100 and joint seat assembly 80 into the forward half hull 20; transporting the apparatus 10 to a destination within a bed portion of a pick-up truck or similar cargo-carrying vehicle; storing the compactly arranged apparatus 10 in a smaller area as compared to a conventional full-length flat bottom boat.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A modular boat assembly, comprising:

a forward half hull portion, comprising a fore starboard wall, a fore port wall, a fore front wall, a fore floor wall, and a rear bulkhead;

an aft half hull portion, comprising an aft starboard wall, an aft port wall, an aft rear wall, an aft floor wall, and a fore bulkhead, said aft half hull portion comprising a width slightly larger than said forward half hull portion;

a boat joining means for conjoining and securing said forward half hull portion to said aft half hull portion, comprising:

a pair of posts located aft of said rear bulkhead and extending rearward from said fore starboard wall, said fore port wall, and said fore floor wall, each having bottom end portions spanned by a bottom post and a top end having an aperture;

a pair of channels located fore of said fore bulkhead and extending forward from said aft starboard wall, said aft port wall, and said aft floor wall, each having bottom end portions spanned by a bottom channel and a top end having an aperture; and, a pair of fasteners; and, a removable seat assembly attachable to said forward half hull portion and said aft half hull portion and covering said boat joining means;

wherein said forward half hull portion further comprises a downwardly-tapering unitary structure;

wherein said assembly is convertible between a constructed version and a deconstructed version;

wherein said rear bulkhead of said forward half hull portion and said fore bulkhead of said aft half hull portion conjoin when said pair of posts and said bottom post are inserted into said pair of channels and said bottom channel, respectively, to achieve said constructed version;

wherein said fasteners are inserted within aligned apertures of said pair of posts and said pair of channels to secure said assembly in said constructed version;

wherein said boat joining means is a waterproof construction; and, wherein said forward half hull portion and said removable seat assembly is adaptable to be stored within said aft half hull portion when said assembly is in said deconstructed version.

2. The assembly of claim 1, further comprising a pull handle located at an outer surface of said fore front wall.

3. The assembly of claim 1, further comprising:

a plurality of fore parallel stiffeners located at inner surfaces of said forward half hull portion and spanning between said fore front wall and said rear bulkhead; and, a plurality of aft parallel stiffeners located at inner surfaces of said aft half hull portion and spanning between said fore bulkhead and said aft rear wall.

4. The assembly of claim 1, further comprising a floatation enclosure extending across and integrated into a bow portion of said forward half hull portion;

wherein said flotation enclosure is adapted to receive a quantity of buoyant material.

5. The assembly of claim 1, further comprising a mounting panel attached to an inner surface portion of said aft rear wall;

wherein said mounting panel is adapted to affix an outboard motor thereto.

6. The assembly of claim 1, further comprising a pair of gusset plates affixed to top outer corner junctions of said aft starboard wall and said aft port wall with said aft rear wall.

7. The assembly of claim 1, wherein said removable seat assembly further comprises:

a seating panel, comprising a "U"-shaped structure;

a pair of cut-out portions; and, a pair of joint attachment brackets each adjacent to one of said pair of cut-out portions;

wherein said pair of cut-out portions are removably positioned about a top of said pair of channels, such that said pair of joint attachment brackets abut said pair of channels and said apertures of each of said pair of joint attachment brackets are aligned with said apertures of said pair of channels and said pair of posts;

wherein said seating panel covers said pair of channels, said fore bulkhead, and said aft bulkhead when said assembly is in said constructed version; and, wherein said pair of fasteners secure said seating panel to said assembly when in said constructed version.

8. A modular boat assembly, comprising:

a forward half hull portion, comprising a fore starboard wall, a fore port wall, a fore front wall, a fore floor wall, and a rear bulkhead;

an aft half hull portion, comprising an aft starboard wall, an aft port wall, an aft rear wall, an aft floor wall, and a fore bulkhead, said aft half hull portion comprising a width slightly larger than said forward half hull portion;

a boat joining means for conjoining and securing said forward half hull portion to said aft half hull portion, comprising:

a pair of posts located aft of said rear bulkhead and extending rearward from said fore starboard wall, said fore port wall, and said fore floor wall, each having a bottom end portions spanned by a bottom post and a top end having an aperture;

a pair of channels located fore of said fore bulkhead and extending forward from said aft starboard wall, said aft port wall, and said aft floor wall, each having a bottom end portions spanned by a bottom channel and a top end having an aperture; and, a pair of fasteners;

a removable seat assembly attachable to said forward half hull portion and said aft half hull portion and covering said boat joining means; and, at least one auxiliary seat assembly each selectively removably attached to an auxiliary seat attachment means;

wherein said assembly is convertible between a constructed version and a deconstructed version;

wherein said rear bulkhead of said forward half hull portion and said fore bulkhead of said aft half hull portion conjoin when said pair of posts and said bottom post are inserted into said pair of channels and said bottom channel, respectively, to achieve said constructed version;

wherein said fasteners are inserted within aligned apertures of said pair of posts and said pair of channels to secure said assembly in said constructed version;

wherein said boat joining means is a waterproof construction;

wherein said auxiliary seat attachment means attaches said at least one auxiliary seat assembly to said either said forward half hull portion or said aft half hull portion; and, wherein said forward half hull portion and said removable seat assembly is adaptable to be stored within said aft half hull portion when said assembly is in said deconstructed version.

9. The assembly of claim 8, wherein said forward half hull portion further comprises a downwardly-tapering unitary structure.

10. The assembly of claim 9, further comprising a pull handle located at an outer surface of said fore front wall.

11. The assembly of claim 9, further comprising:

a plurality of fore parallel stiffeners located at inner surfaces of said forward half hull portion and spanning between said fore front wall and said rear bulkhead; and, a plurality of aft parallel stiffeners located at inner surfaces of said aft half hull portion and spanning between said fore bulkhead and said aft rear wall.

12. The assembly of claim 9, further comprising a floatation enclosure extending across and integrated into a bow portion of said forward half hull portion;

wherein said flotation enclosure is adapted to receive a quantity of buoyant material.

13. The assembly of claim 9, further comprising a mounting panel attached to an inner surface portion of said aft rear wall;

wherein said mounting panel is adapted to affix an outboard motor thereto.

14. The assembly of claim 9, further comprising a pair of gusset plates affixed to top outer corner junctions of said aft starboard wall and said aft port wall with said aft rear wall.

15. The assembly of claim 10, wherein said removable seat assembly further comprises:

a seating panel, comprising a "U"-shaped structure;

a pair of cut-out portions; and, a pair of joint attachment brackets each adjacent to one of said pair of cut-out portions;

wherein said pair of cut-out portions are removably positioned about a top of said pair of channels, such that said pair of joint attachment brackets abut said pair of channels and said apertures of each of said pair of joint attachment brackets are aligned with said apertures of said pair of channels and said pair of posts;

wherein said seating panel covers said pair of channels, said fore bulkhead, and said aft bulkhead when said assembly is in said constructed version; and, wherein said pair of fasteners secure said seating panel to said assembly when in said constructed version.

16. The assembly of claim 9, wherein said auxiliary seat attachment means further comprises a pair of support brackets affixed to opposing and aligned inner surfaces and spanning a distance between a pair of stiffeners of either said fore starboard wall and said fore port wall or said aft starboard wall and said aft port wall.

17. The assembly of claim 16, wherein said at least one auxiliary seat assembly further comprises:

an auxiliary seat panel having a channel-shaped cross-section sized to span an inner width of either said forward half hull portion or said aft half hull portion;

a pair of first hooks located on one short side of said auxiliary seat panel and extending outwardly therefrom;

a pair of locking bracket assemblies located on an opposing short side from said pair of first hooks, each further comprising:

a bracket track affixed to a bottom surface of said auxiliary seat panel;

a locking bracket extension slidingly engaged within said bracket track, further comprising a second hook extending outwardly therefrom;

a slot located within said locking bracket extension; and, a locking bracket fastener insertingly received through said slot;

wherein said pair of first hooks is selectively placed on an underside surface of one of said pair of support brackets;

wherein said auxiliary seat panel is placed on an upper side surface of each of said pair of support brackets;

wherein said pair of locking bracket assemblies are selectively motioned laterally so as to enable said second hooks to be placed on an underside surface of an opposing one of said pair of support brackets; and, wherein said locking bracket fastener fastens a desired lateral position of said locking bracket extension within said bracket track of each of said pair of locking bracket assemblies.

* * * * *